US006003161A

United States Patent [19]

Tomaini

[11] Patent Number: 6,003,161

[45] Date of Patent: Dec. 21, 1999

[54] TOILET WATER SAVER ALERT SYSTEM

[76] Inventor: John J. Tomaini, 91 Locust Ave., West Long Branch, N.J. 07764

[21] Appl. No.: 09/073,542

[22] Filed: May 6, 1998

[51] Int. Cl.[6] ..... E03D 1/00

[52] U.S. Cl. ..... 4/415; 4/227.5

[58] Field of Search ..... 4/227.1–227.5, 4/415

[56] References Cited

U.S. PATENT DOCUMENTS

| | | | |
|---|---|---|---|
| 3,241,718 | 3/1966 | Kemper | 4/227.2 X |
| 3,953,902 | 5/1976 | Taylor | 4/227 |
| 4,455,692 | 6/1984 | Hegge et al. | 4/228 |
| 4,491,988 | 1/1985 | Mizuno | 4/228 |
| 4,632,350 | 12/1986 | Brown | 248/295 |
| 4,872,222 | 10/1989 | Pavlik | 4/227.1 X |
| 5,073,992 | 12/1991 | Herring et al. | 4/227.1 |
| 5,073,993 | 12/1991 | Dewaal | 4/227.1 |

*Primary Examiner*—Charles E. Phillips
*Attorney, Agent, or Firm*—Gibbons, Deldeo, Dolan Griffinger & Vecchione

[57] ABSTRACT

Dual chambers are suspended from a toilet tank rim with selective height adjustment. The first chamber contains a liquid, water-soluble dye and a plunger pump to dispense dye into the tank water to test the toilet flapper valve. The second chamber contains a solid, water-soluble dye and a perforated floor to admit water in the event the tank water level rises due to toilet fill valve leakage, whereupon the dye will be evident. Optional first and second baskets hold various chemical products such as disinfecting cleaners.

20 Claims, 4 Drawing Sheets

TOILET WATER SAVER ALERT SYSTEM

FIELD OF THE INVENTION

This invention relates to the field of baths, closets, sinks and spittoons, and more particularly to the field of dye packs that are designed to be used in toilet flush tanks to detect leaks.

BACKGROUND OF THE INVENTION

Dye packs for toilet tank leak detection are known and have been configured in different ways. Some examples of dye leak detection systems in the prior art are seen in the following United States patents:

Pavilik, U.S. Pat. No. 4,872,222, shows a lever handle external to the tank connected by a line to a dye pack to raise and lower the dye pack into the water.

Brown, U.S. Pat. No. 4,632,350, discloses a vertically adjustable, rotatable hanger for supporting two dispensers for adding chemical products or dye to a toilet tank.

Hegge, U.S. Pat. No. 4,455,692, illustrates a vertically adjustable safety hanger is for two toilet cleansing packs.

Mizzuno, U.S. Pat. No. 4,491,988, discloses an apparatus to store and dispense chemical products in solid, liquid, or gel state. The products are stored in a reservoir as solute. Water is introduced to the reservoir through an inlet valve on top of the apparatus, creating a solution. The solution is held until the water level in the tank decreases by flushing. The solution is then released through an outlet valve into the tank, where it is carried into the bowl.

Taylor, U.S. Pat. No. 3,953,902, shows a device for the addition of a liquid chemical product to the toilet tank, using a reservoir external to the tank. Air pressure regulates the mixing of water with product.

While the above-described devices serve to deliver chemical products to the water in a toilet tank, none of them will test both the fill valve and the flapper valve. None will test the fill valve automatically and continuously, without human intervention. None will selectively dispense a liquid test dye into the water immediately when needed. Nor will they dispense two different dyes for testing leaks, and also dispense one or two different chemical products such as disinfecting cleaners.

Accordingly, there is a need to provide a toilet chemical dispensing system that will test both the fill valve and the flapper valve.

There is a further need to provide a toilet chemical dispensing system that will test the fill valve automatically and continuously, without human intervention.

There is a yet further need to provide a toilet chemical dispensing system that will selectively dispense a liquid test dye into the water immediately when needed.

There is a still further need to provide a toilet chemical dispensing system that will dispense two different dyes for testing leaks, and also dispense one or two different chemical products such as disinfecting cleaners.

SUMMARY OF THE INVENTION

In accordance with the present invention, there is provided a toilet water saver alert apparatus for use in connection with a toilet having a bowl and a tank, the tank having a water level, a rim, a fill valve, and a flapper valve, the apparatus comprising: a first chamber disposed within the tank, the first chamber having a waterline; a colored, liquid, water-soluble dye contained within the first chamber; pumping means, connected to the first chamber, for selectively pumping a predetermined quantity of the dye into the tank, so as to test the flapper valve, with subsequent visual observation of the dye in the bowl in the event of flapper valve leakage; a second chamber attached to the first chamber, the second chamber having a waterline aligned with the first chamber waterline, the second chamber having a floor at or below the waterline, the tank communicating with the second chamber so as to admit water therein when the tank water level rises above the chamber floor; a colored dye contained within the second chamber, so that in the event of fill valve leakage, the water level will rise, dissolving the dye, with subsequent visual observation of the dye in: the tank prior to flushing, the bowl upon flushing or the bowl after entering the overflow valve and prior to flushing; and supporting means, having selective height adjustment, for supporting the first and second chambers from the tank rim so that the floor of the second chamber is located between the tank water level and the top of the overflow valve.

The invention further provides a method for detecting leakage past a flapper valve, for use in connection with a toilet having a bowl and a tank, the tank having a water level, a rim, a fill valve, and the flapper valve, the method comprising the steps of: indicating a waterline on an enclosed first chamber; placing the first chamber within the tank; supporting the first chamber by the tank rim; introducing a colored, liquid, water-soluble dye into the first chamber; connecting a pump to the first chamber, pumping a predetermined quantity of the dye into the tank, so as to test the flapper valve; and observing visual evidence of the dye in the bowl to determine flapper valve leakage.

The method further comprises the steps of: indicating a waterline at a predetermined distance at or above a floor on a second chamber; placing the second chamber within the tank; supporting the second chamber by the tank rim; providing perforations on the second chamber, to communicate the tank with the second chamber; adjusting the floor, selectively, between the tank water level and the top of the fill valve; introducing a colored, solid, water-soluble dye into the second chamber; admitting water into the second chamber when the tank water level rises above the second chamber floor due to fill valve leakage; dissolving the dye in the tank water; and observing visual evidence of the dye in the bowl (or tank) to determine fill valve leakage.

The method further comprises the steps of: juxtaposing a first basket between the first and second chambers; positioning a floor of the first basket at a predetermined distance below the waterline; communicating the tank with the first basket by perforating the first basket; admitting water into the first basket through the perforations; inserting a block of solid chemical product into the first basket so that a lowermost portion of the block is submerged; dissolving the lowermost portion of the block slowly into the tank water; and allowing the remainder of the block to descend into the water as the lowermost portion dissolves, thereby continuously time-releasing the chemical product.

BRIEF DESCRIPTION OF THE DRAWINGS

A more complete understanding of the present invention may be obtained from consideration of the following description in conjunction with the drawings, in which.

DETAILED DESCRIPTION OF VARIOUS ILLUSTRATIVE EMBODIMENTS

Although the present invention, toilet water saver alert apparatus is particularly well suited for two piece toilets having a bowl and tank, and shall be so described in this application, the toilet water saver alert apparatus is equally well suited for use in one piece toilets and low profile toilets.

Figure 2:
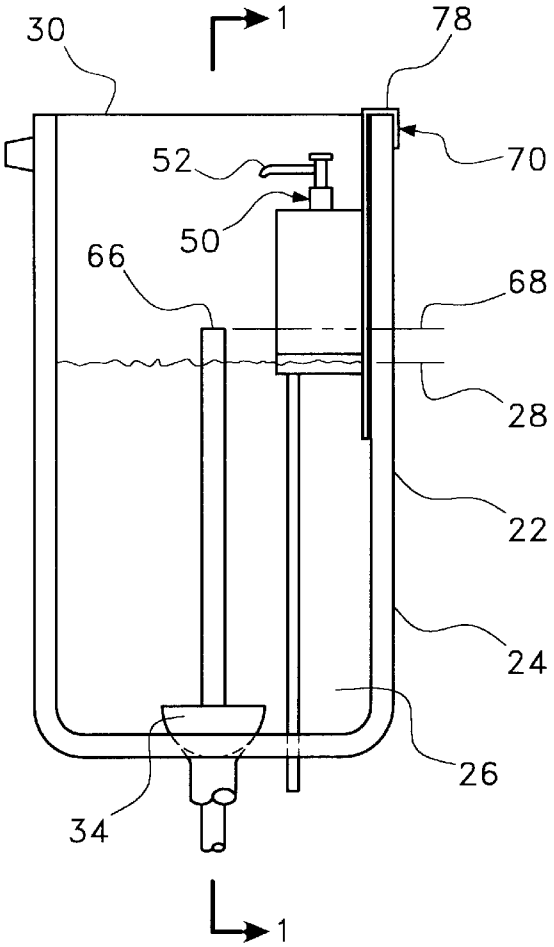
FIG. 2 is a right side elevational cross-sectional view of the tank of FIG. 1, taken along lines 2—2 of FIG. 1.
Figure 1:
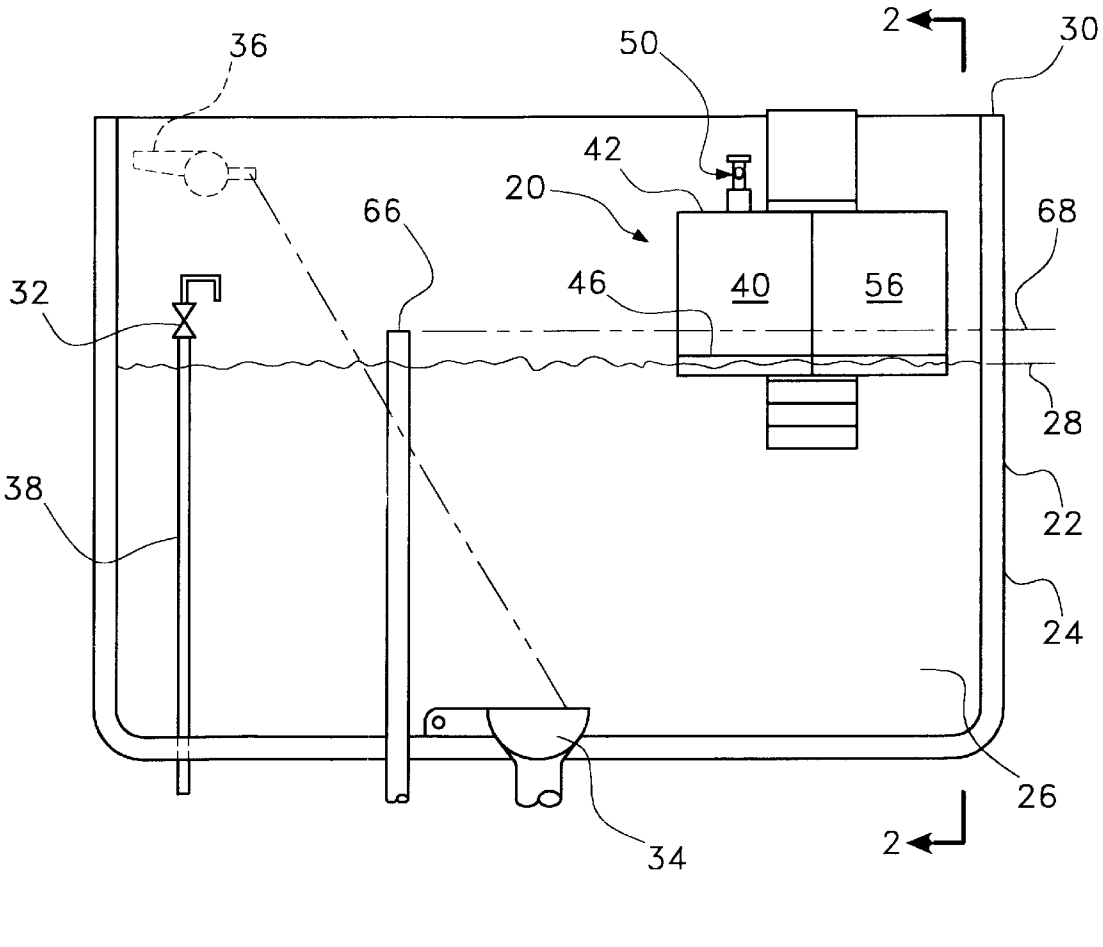
FIG. 1 is a front elevational cross-sectional view of a toilet tank with a toilet water saver alert apparatus installed, taken along lines 1—1 of FIG. 2.
Figure 3:
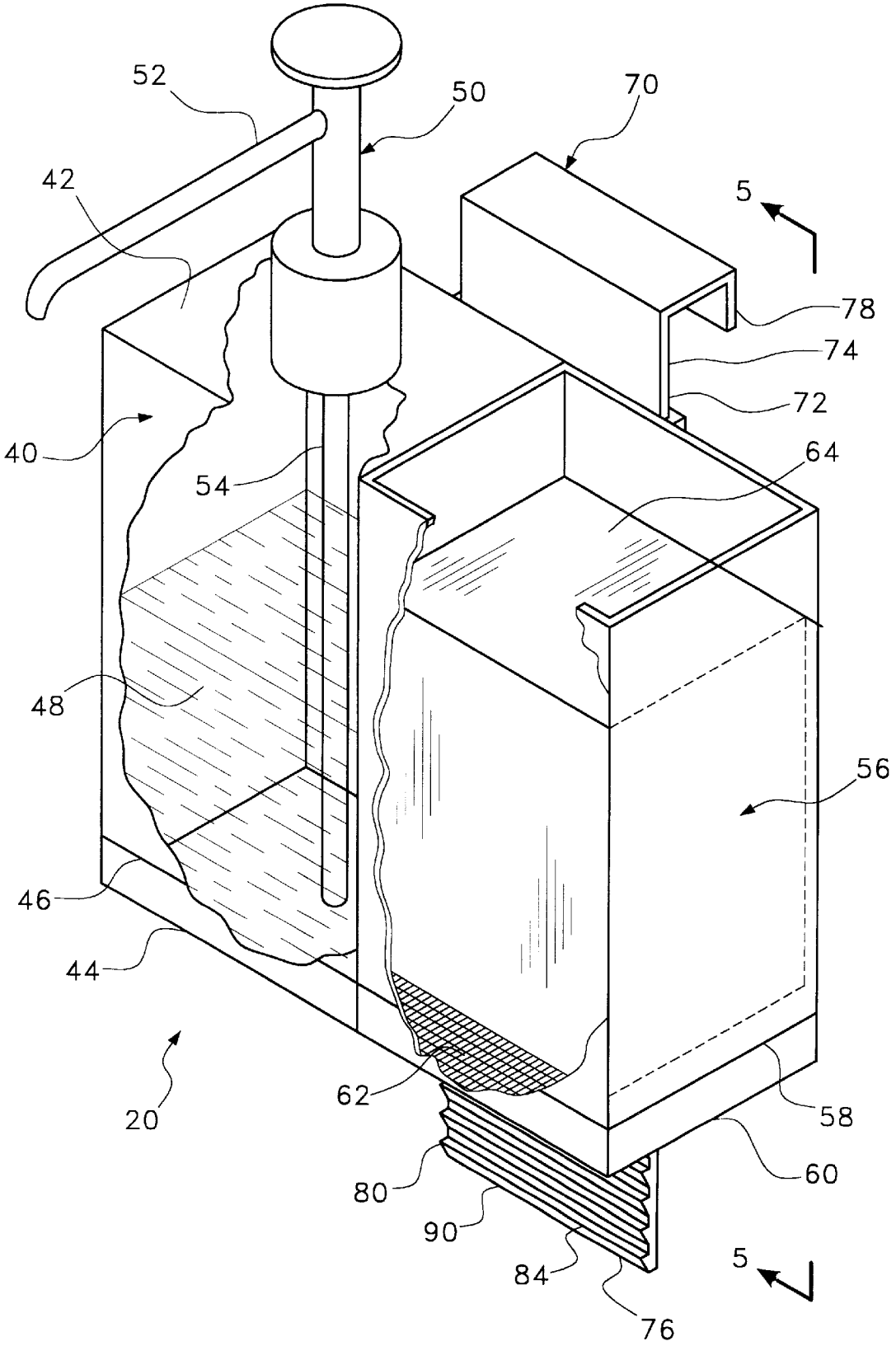
FIG. 3 is a front isometric view of a toilet water saver alert apparatus constructed in accordance with the invention.

Referring now to the drawing, and especially to FIGS. 1, 2 and 3 thereof, a toilet water saver alert apparatus is shown at 20, and is for use in connection with a toilet 22. The toilet 22 has a bowl (not shown), and has a tank 24 with water 26, a water level 28, a rim 30, a fill valve 32, a flapper valve 34, a flush handle 36, and a water supply 38. The apparatus comprises a first chamber 40 disposed within the tank 24.

The first chamber 40 is enclosed and has a top 42, a bottom 44, and a waterline 46. The waterline(s) act as a guide for determining the vertical position of a chamber with respect to the actual waterline of the tank. A colored, liquid, water-soluble dye 48 is contained within the first chamber 40. A dispensing means, for example, a plunger type pump 50 is mounted on the first chamber top 42. The plunger type pump 50 is manually operated, and has an outlet spout 52, and an inlet tube 54 extending toward the first chamber bottom 44. The plunger type pump 50 selectively pumps a predetermined quantity of the dye 48 into the tank 24, to test the flapper valve 34. Alternatively, a flow valve could be located at the bottom of the chamber for selectively dispensing the contents of the chamber using gravity. In the event of flapper valve leakage, dye 48 will leak past the flapper valve 34 into the bowl, and will be subsequently observed visually in the bowl.

A second chamber 56 is attached to the first chamber 40. The second chamber 56 has a waterline 58 aligned with the first chamber waterline 46. The second chamber 56 has a floor 60 which as shown is at a predetermined distance below the waterline 58. It would be understood, however, that the floor of the second chamber can be at the same height as the waterline. In addition, the waterline can be located below the floor in order to assist with the location of the chamber relative the tank water level, wherein the second chamber may be mounted so that its waterline and the normal tank water level are in juxtaposition.

The second chamber 56 has perforations 62 communicating the tank 24 with the second chamber 56 to admit water therein when the tank water level 28 rises above the chamber waterline 58. Although perforations are shown only at the bottom of the second chamber, it would be understood that any or all of the front, back and side sections of the second chamber could also be perforated. A colored, solid, water-soluble dye 64 is contained within the second chamber 56. In the event of fill valve 32 leakage, or water supply tube 38 leakage, the water level 28 will rise from the preset height 28 to a height above the floor and/or waterline. The water then will enter the second chamber 56 through the perforations 62, dissolving the dye 64 into the tank so that a fill valve or water supply tube leak may be detected immediately by looking within the tank or, for example, in the bowl at the time of flushing. In the event the water continues to rise for example, to the height 68 of the overflow tube 66, the dyed water will then enter the overflow tube 66 and subsequently enter and be visually observed in the bowl before flushing. Preferably, the color of the dye in the first chamber and the second chamber are different so that one may distinguish between the different types of leaks, although such a feature is not necessary.

Turning now to FIGS. 4, 5, 6 and 7, as well as 1,2 and 3, supporting means 70 is provided, having selective height adjustment, for supporting the first chamber 40 and second 56 chamber from the tank rim 30 so that the waterlines 46 and 58 respectively, are juxtaposed with the tank water level 28.

In one exemplary embodiment, the supporting means 70 includes a generally vertical element 72 for positioning the chambers at selected heights within the tank. The selectable positioning means can be either by force fit or by engagement between elements or protrusions of the vertical elements and overall chamber structures. As shown, the vertical element 72 has opposite upper 74 and lower 76 ends. A hook 78 is attached to the vertical element upper end 74. The hook 78 engages the tank rim 30. The hook 78 has sufficient width to prevent transverse rocking of the chambers 40 and 56.

A plurality of projecting members 80 are spaced along the vertical element 72. The projecting members 80 each include an upper flat surface 82 having generally horizontal elongate 84 and short 86 aspects. The projecting members 80 each also include a lower beveled surface 88 having a generally horizontal elongate aspect 90, and an upward and outward sloping short aspect 92.

Figure 4:
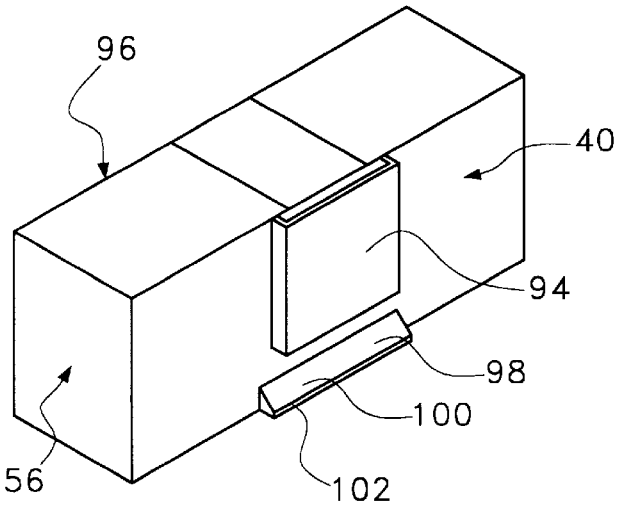
FIG. 4 is a rear isometric view of the apparatus of FIG. 3.
Figure 5:
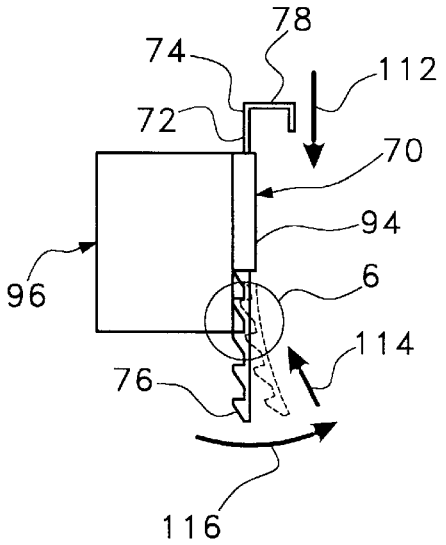
FIG. 5 is a right side elevational view of the apparatus of FIG. 3, taken along lines 5—5 of FIG. 3.

A sleeve 94 is attached to at least one of the chambers, typically to both chambers 40 and 56, as shown in FIG. 4. The sleeve 94 slidingly engages the vertical element 72, as shown in FIG. 5. A containment unit 96 is formed by the sleeve 94, the first chamber 40, and the second chamber 56.

A step 98 is attached to the containment unit 96. The step 98 selectively engages one of the vertical element projecting members 80, to support the containment unit 96 on the tank rim 30. The step 98 includes an upper beveled surface 100 having a generally horizontal elongate aspect 102, and a downward and outward sloping short aspect 104. The step 98 also includes a lower flat surface 106 having generally horizontal elongate 108 and short 110 aspects.

Figure 6:
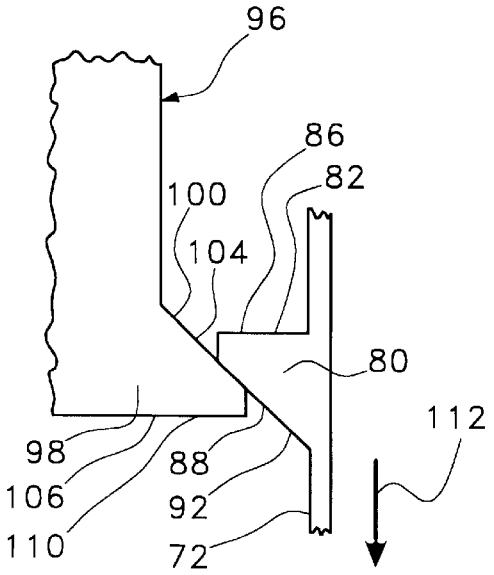
FIG. 6 is an enlarged view of detail 6 of FIG. 5.
Figure 7:
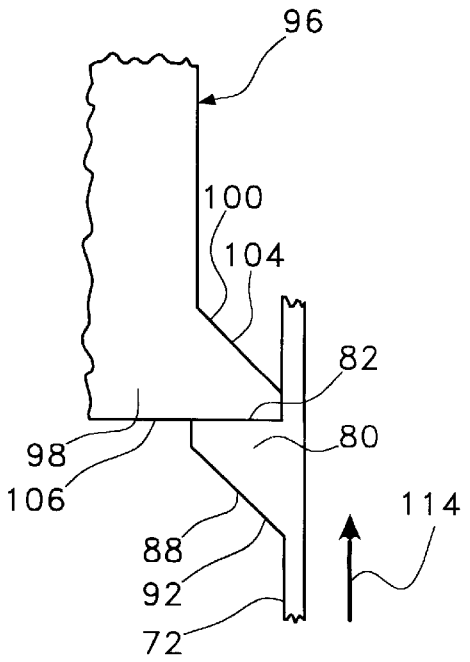
FIG. 7 is an enlarged view of detail 6 of FIG. 5.

In operation, as the vertical element 72 slides downward through the sleeve 94, as shown by arrow 112, each projecting member beveled surface 88, in sequence, will slide upon the step beveled surface 100, the vertical element 72 will bend away from the step 98, and the projecting member 80 will pass over the step 98, as shown in FIG. 6. Conversely, as the vertical element 72 slides upward through the sleeve 94, as shown by arrow 114, the flat surface 82 of one of the projecting members 80 will engage the step flat surface 106, arresting the upward movement, as shown in FIG. 7. In order to slide the vertical element 72 upward past the step 98, the vertical element lower end 76 is selectively bent away from the step 98, as shown by arrow 116 in FIG. 5, to allow the projecting member 80 to pass over the step 98, as the vertical element lower end 76 is urged upward 114.

In this manner, the first 40 and second 56 chambers will be supported from the tank rim 30 with selective height adjustment, so that the waterlines 46 and 58 are respectively, either juxtaposed with, or located a distance above the tank water level 28.

Figure 8:
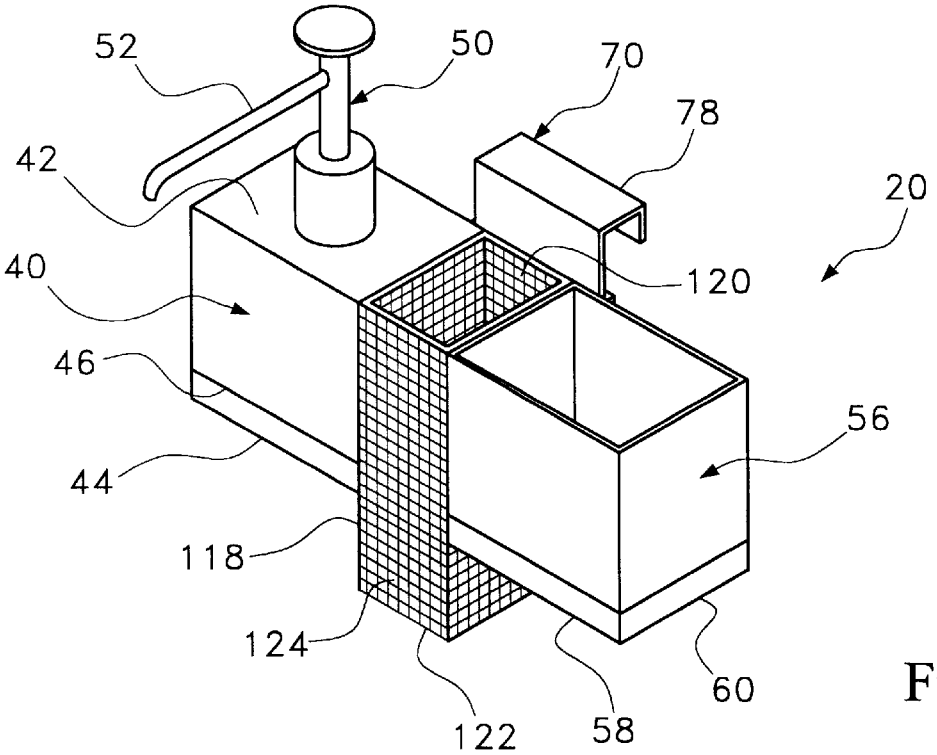
FIG. 8 is an isometric view of another toilet water saver alert apparatus constructed in accordance with the invention.

Referring now to FIG. 8, an optional first basket 118 is disposed between the first 40 and second 56 chambers. The first basket 118 has an open top 120 and a floor 122 at a predetermined distance below the waterline 46 and 58. The first basket 118 has perforations 124 communicating the tank 24 with the first basket 118 to admit water 26 therein. A block of solid chemical product (not shown) is contained within the first basket with a lowermost portion of the block submerged. As the lowermost portion of the block is slowly dissolved into the tank water, the remainder of the block will descend into the water, thereby time-releasing the chemical product.

Figure 9:
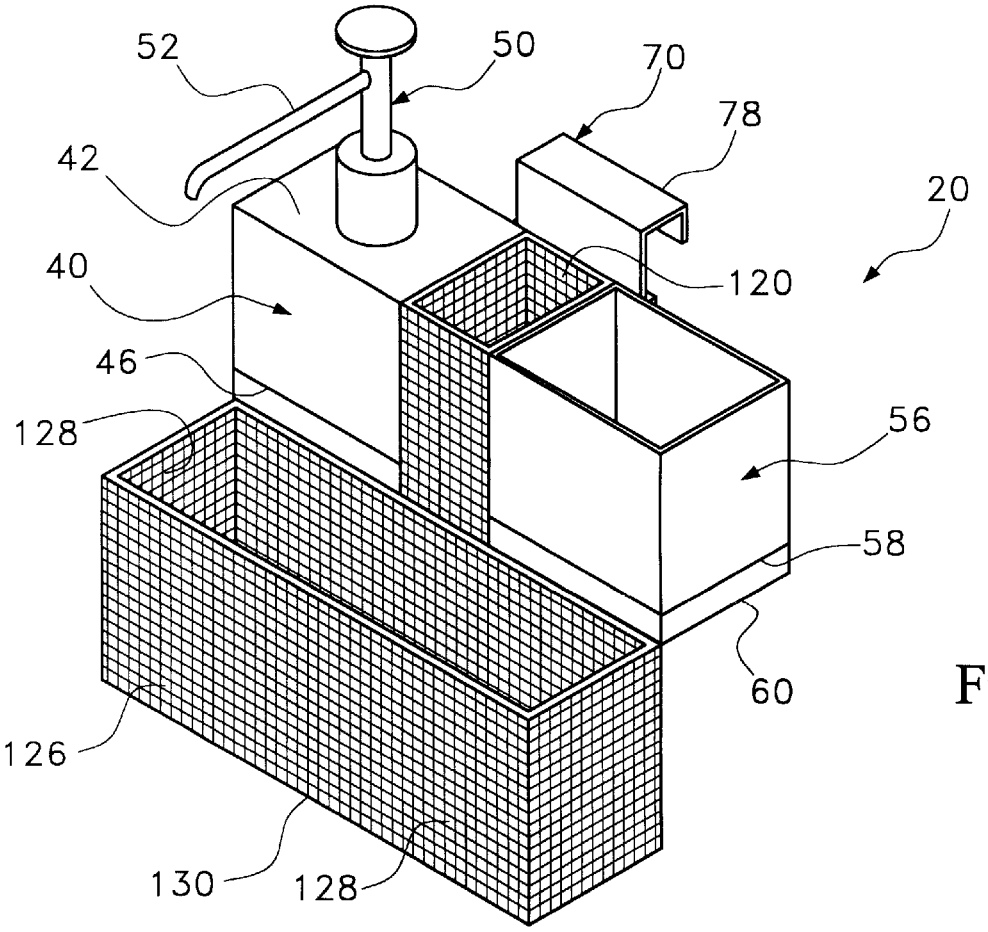
FIG 9 is a front isometric view of yet another toilet water saver alert apparatus constructed in accordance with the invention.

Turning now to FIG. 9, another option is a second basket 126 disposed adjacent the first 40 and second 56 chambers. The second basket 126 has an open top 128 and a floor 130 at a predetermined distance below the waterline 46 and 58. The second basket 126 has perforations 128 communicating the tank 24 with the second basket 126 to admit water 26 therein. A block of another, different solid chemical product (not shown) is contained within the second basket. This block, completely submerged, is slowly dissolved into the tank water, thereby releasing the chemical product. Thus, a choice of chemical products and delivery methods is available. The chemical products are typically water-soluble disinfecting cleaners.

Numerous modifications and alternative embodiments of the invention will be apparent to those skilled in the art in view of the foregoing description. For example, the present invention may also be comprised of only one of the chambers which may be selectively mounted with a vertical positioning element within the tank. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed:

1. A toilet water saver alert apparatus for use in connection with a toilet having a bowl and a tank, the tank having a water level, a rim, a fill valve, and a flapper valve, the apparatus comprising:

a first chamber disposed within the tank adapted to receive a first colored, liquid, water-soluble dye;

dispensing means, connected to the first chamber, for selectively dispensing a predetermined quantity of the first dye into the tank, so as to test the flapper valve, with subsequent visual observation of the first dye in the bowl in the event of flapper valve leakage;

a second chamber attached to the first chamber, the second chamber having a floor, the tank communicating with the second chamber so as to admit water therein when the tank water level rises above the chamber floor;

said second chamber adapted to receive and contain a second water soluble colored dye, so that in the event of fill valve leakage, the water level will rise, dissolving the second dye, for visual observation of the second dye, said second dye being automatically observable within the bowl if said water level continues to rise and enters an overflow tube in said tank; and supporting means, having selective height adjustment, for supporting the first and second chambers from the tank rim so that the floor of said second chamber can be located between a normal tank water level and a top of said overflow tube.

2. The apparatus as recited in claim 1, wherein the supporting means includes:

a generally vertical element having opposite upper and lower ends;

a hook attached to the vertical element upper end, the hook engaging the tank rim, the hook having sufficient width to prevent transverse rocking of the chambers;

a plurality of projecting members spaced along the vertical element;

a sleeve attached to at least one of the chambers, the sleeve slidingly engaging the vertical element;

a containment unit formed by the sleeve, the first chamber, and the second chamber; and a step attached to the containment unit, the step selectively engaging one of the vertical element projecting members, so as to support the containment unit on the tank rim.

3. The apparatus as recited in claim 2, wherein:

the step includes an upper beveled surface having a generally horizontal elongate aspect, and a downward and outward sloping short aspect, and includes a lower flat surface having generally horizontal elongate and short aspects; and the projecting members each include an upper flat surface having generally horizontal elongate and short aspects, and each include a lower beveled surface having a generally horizontal elongate aspect, and an upward and outward sloping short aspect; so that as the vertical element slides downward through the sleeve, each projecting member beveled surface, in sequence, will slide upon the step beveled surface, the vertical element will bend away from the step, and the projecting member will pass over the step; and as the vertical element slides upward through the sleeve, the flat surface of one of the projecting members will engage the step flat surface, arresting the upward movement, unless the vertical element is selectively bent away from the step to allow the projecting member to pass over the step, whereby the first and second chambers will be supported from the tank rim with selective height adjustment, so that the waterlines are juxtaposed with the tank water level.

4. The apparatus as recited in claim 3, further comprising:

a first basket disposed proximate the first and second chambers, the first basket having a floor and having perforations communicating the tank with the first basket so as to admit water therein; and said first basket for holding a block of solid chemical product contained within the first basket with a lowermost portion of the block submerged, such that as the lowermost portion of the block is slowly dissolved into the tank water, the remainder of the block will descend into the water, thereby time-releasing the chemical product.

5. The apparatus as recited in claim 4, further comprising:

a second basket disposed adjacent the first and second chambers, the second basket having a floor at a predetermined distance below the floor of said second chamber and having perforations communicating the tank with the second basket so as to admit water therein; and adapted to receive a block of another solid chemical product contained within the second basket, such that the block is slowly dissolved into the tank water, thereby releasing the chemical product.

6. The apparatus as recited in claim 5, wherein the chemical product is a water-soluble disinfecting cleaner.

7. The apparatus of claim 1, wherein the dye in the first chamber and the dye in the second chamber are of different colors.

8. A toilet water saver alert apparatus for use in connection with a toilet having a bowl and a tank, the tank having a water level, a rim, a fill valve, a flapper valve, a flush handle, and a water supply, the apparatus comprising:

a first chamber disposed within the tank, the first chamber being enclosed and having a top, a bottom, said first chamber adapted to receive a colored, liquid, water-soluble dye within;

a plunger type pump mounted on the first chamber top, the plunger type pump being manually operated, having an outlet spout, and an inlet tube extending toward the first chamber bottom, for selectively pumping a predetermined quantity of the dye into the tank, so as to test the flapper valve, with subsequent visual observation of the dye in the bowl in the event of flapper valve leakage;

a second chamber attached to the first chamber, the second chamber having a floor and having perforations communicating the tank with the second chamber so as to admit water therein when the tank water level rises above the chamber floor;

said second chamber adapted to receive a colored, solid, water-soluble dye, so that in the event of fill valve leakage, the water level will rise, dissolving the dye, with subsequent visual observation of the dye, said dye being automatically observable within the bowl if said water level continues to rise and enters an overflow valve in said tank; and supporting means, having selective height adjustment, for supporting the first and second chambers from the tank rim so that the waterlines are between a normal tank water level and a top of said overflow valve, said floor of said second chamber locatable slightly above said normal tank water level.

9. The apparatus as recited in claim 8, wherein the supporting means includes:

a generally vertical element having opposite upper and lower ends;

a hook attached to the vertical element upper end, the hook engaging the tank rim, the hook having sufficient width to prevent transverse rocking of the chambers;

a plurality of projecting members spaced along the vertical element;

a sleeve attached to at least one of the chambers, the sleeve slidingly engaging the vertical element;

a containment unit formed by the sleeve, the first chamber, and the second chamber; and a step attached to the containment unit, the step selectively engaging one of the vertical element projecting members, so as to support the containment unit on the tank rim.

10. The apparatus as recited in claim 9, wherein:

the step includes an upper beveled surface having a generally horizontal elongate aspect, and a downward and outward sloping short aspect, and includes a lower flat surface having generally horizontal elongate and short aspects; and the projecting members each include an upper flat surface having generally horizontal elongate and short aspects, and each include a lower beveled surface having a generally horizontal elongate aspect, and an upward and outward sloping short aspect; so that as the vertical element slides downward through the sleeve, each projecting member beveled surface, in sequence, will slide upon the step beveled surface, the vertical element will bend away from the step, and the projecting member will pass over the step; and as the vertical element slides upward through the sleeve, the flat surface of one of the projecting members will engage the step flat surface, arresting the upward movement, unless the vertical element is selectively bent away from the step to allow the projecting member to pass over the step, whereby the first and second chambers will be supported from the tank rim with selective height adjustment, so that the waterlines are juxtaposed with the tank water level.

11. The apparatus as recited in claim 10, further comprising:

a first basket disposed proximate the first and second chambers, the first basket having an open top and a floor at a predetermined distance below the floor and having perforations communicating the tank with the first basket so as to admit water therein; and said first basket adapted to receive a block of solid chemical product contained within the first basket with a lowermost portion of the block submerged, such that as the lowermost portion of the block is slowly dissolved into the tank water, the remainder of the block will descend into the water, thereby time-releasing the chemical product.

12. The apparatus as recited in claim 11, further comprising:

a second basket disposed adjacent the first and second chambers, the second basket having an open top and a floor at a predetermined distance below the floor and having perforations communicating the tank with the second basket so as to admit water therein; and a block of another solid chemical product contained within the second basket, such that the block is slowly dissolved into the tank water, thereby releasing the chemical product.

13. The apparatus as recited in claim 12, wherein the chemical product is a water-soluble disinfecting cleaner.

14. The apparatus of claim 8, wherein the liquid dye and solid dye are different colors.

15. A method for detecting fill valve leakage, for use in connection with a toilet having a bowl and a tank, the tank having a water level, a rim, a fill valve, and the flapper valve, the method comprising the steps of:

providing a floor on a second chamber;

placing the second chamber within the tank;

supporting the second chamber by the tank rim;

the second chamber having perforations to communicate the tank with the second chamber;

adjusting, selectively, the height of the floor of the second chamber such that the floor is slightly above the tank water level;

introducing a colored, solid, water-soluble dye into the second chamber;

admitting water into the second chamber when the tank water level rises above the second floor due to fill valve leakage;

dissolving the dye in the tank water; and observing visual evidence of the dye to determine said leakage.

16. The method of claim 15, wherein the dye enters an overflow tube and is observed in the bowl to determine fill valve leakage.

17. The method as recited in claim 15, further comprising a method for flapper valve leakage, the method comprising the steps of:

placing a first chamber within the tank;

supporting the first chamber by the tank rim;

introducing a colored, liquid, water-soluble dye into the first chamber;

connecting a pump to the first chamber;

pumping a predetermined quantity of the dye into the tank, so as to test the flapper valve; and observing visual evidence of the dye in the bowl to determine flapper valve leakage.

18. The method as recited in claim 15, further comprising the steps of:

placing a first basket proximate the first and second chambers;

positioning a floor of the first basket at a predetermined distance below the tank water level;

communicating the tank with the first basket by providing perforations in the first basket;

admitting water into the first basket through the perforations;

inserting a block of solid chemical product into the first basket so that a lowermost portion of the block is submerged;

dissolving the lowermost portion of the block slowly into the tank water; and allowing the remainder of the block to descend into the water as the lowermost portion dissolves, thereby continuously time-releasing the chemical product.

19. The method of claim 15, wherein said step of adjusting further includes the steps of indicating a waterline on said second chamber and utilizing said waterline to adjust the height of said second chamber relative said tank water level.

20. A toilet water saver alert apparatus for use in connection with a toilet having a bowl and a tank, the tank having a normal water level, a rim, a fill valve, and a flapper valve, the apparatus comprising:

a first chamber having a floor, the tank communicating with the chamber so as to admit water therein when the tank water level rises above the floor;

said chamber adapted to receive and contain a colored dye, so that in the event of fill valve leakage, the water level will rise above the floor, dissolving the dye, for visual observation of the dye; and supporting means, having selective height adjustment, for supporting the chamber from the tank rim so that the floor may be located slightly above the tank water level and below a top of an overflow tube with the tank, said chamber further including a waterline alignment indicator disposed thereon, said waterline alignment indicator operable as a guide for determining a vertical position of the chamber with respect to the tank water level such that said floor of said chamber is positioned between the tank water level and the top of said overflow tube when said waterline alignment indicator is aligned with said normal water level of said tank;

further including a second chamber coupled to said first chamber, said second chamber adapted to receive a first colored, liquid, water-soluble dye; and dispensing means, attachable to said second chamber, for selectively dispensing a predetermined quantity of the first dye into the tank, so as to test the flapper valve, with subsequent visual observation of the first dye in the bowl in the event of flapper valve leakage.

* * * * *